US005247746A

United States Patent [19]

Johnson et al.

[11] Patent Number: 5,247,746

[45] Date of Patent: Sep. 28, 1993

[54] TRAY SEALING AND GAS FLUSH APPARATUS

[75] Inventors: Randall E. Johnson, Campobello; Howard D. Conner, Mauldin; Thomas M. Bagwell, Jr., Simpsonville; Charles C. Zende, Greer, all of S.C.

[73] Assignee: W. R. Grace & Co.-Conn., Duncan, S.C.

[21] Appl. No.: 893,861

[22] Filed: Jun. 4, 1992

[51] Int. Cl.[5] ..... B65B 31/04; B65B 31/06

[52] U.S. Cl. ..... 53/432; 53/109; 53/510; 53/478

[58] Field of Search ..... 53/432, 433, 510, 511, 53/109, 79, 403, 478, 477

[56] References Cited

U.S. PATENT DOCUMENTS

| | | | |
|---|---|---|---|
| 3,026,656 | 3/1962 | Rumsey, Jr. | 53/432 |
| 3,343,332 | 9/1967 | Mahaffy et al. | 53/433 |
| 3,673,760 | 7/1972 | Canamero et al. | 53/432 |
| 4,409,252 | 10/1983 | Buschkens et al. | 53/109 X |
| 4,624,099 | 11/1986 | Harder | 53/432 |
| 4,685,274 | 8/1987 | Garwood | 53/433 |
| 5,071,667 | 12/1991 | Grüne et al. | 53/432 X |

*Primary Examiner*—James F. Coan

*Attorney, Agent, or Firm*—William D. Lee, Jr.; Mark B. Quatt; Leigh P. Gregory

[57] ABSTRACT

Apparatus for atmosphere-modifying and sealing individual trays includes a film disposing roller disposed closely adjacent the top of the tray to define a nip region and an elongated gas injection nozzle spanning the nip region for injecting gas through the nip region between the film and the tray. A split conveyor belt advances the trays past the film disposing roller to a sealing unit utilizing band sealers for the longitudinal tray edges and reciprocal "hot bar" sealer for the leading and trailing tray edges. The gas injection nozzle injects the gas substantially perpendicular to the advancing direction, down and into the individual trays. An optional second gas nozzle provides a gas flow curtain across the tray leading edge.

10 Claims, 3 Drawing Sheets

TRAY SEALING AND GAS FLUSH APPARATUS

BACKGROUND OF THE INVENTION

1. Field of the Invention

The present invention relates to apparatus for modifying the gas atmosphere of individual trays containing e.g., foodstuffs, and for sealing the individual trays with the modified gas atmosphere.

2. Description of the Prior Art

The modern trend toward increased convenience in preparing meals has caused a significant and fundamental change in the way most foodstuffs are packaged and sold at retail stores. Rather than sell in bulk quantities, supermarkets and convenience stores typically market such foodstuffs as meats, poultry, dairy products, etc. in relatively small portions suitable for only a few servings. Typically, such foodstuffs are processed at a processing plant from bulk quantities into single or multiple serving sizes and packaged in individual trays. The trays generally have a flanged peripheral edge surrounding a recessed portion, and a clear film cover for display purposes.

A significant problem occasioned by the marketing of smaller sized portions of perishable foodstuffs is the possibility of increased spoilage rate and reduced shelf life. The smaller portions typically have a larger ratio of surface area to volume which accelerates the chemical and bacterial attack on the product. This problem has put a premium on the control of the atmosphere surrounding the packaged food stuffs. For example, there can often result the need to reduce or enrich the oxygen content of the atmosphere surrounding the foodstuffs to retard spoilage induced by chemical action and bacteria, in order to extend the shelf life and appearance of the foodstuffs.

Conventional tray wrapping/packaging machines, including those which attempt to replace or enrich the oxygen atmosphere by the use of a gas flush tunnel, vacuum chamber, or other component charged with an atmosphere-modifying gas, have not been entirely satisfactory or have proved more costly than desired due to the need, for example, of associated vacuum pump apparatus. Also, the intermittent motion and resulting slow cycle speeds which characterize conventional tray wrapping and packaging machines make them economically less attractive to operate. These shortcomings are believed to be the result of the additional complexity due to the tunnel components and vacuum chambers and the inability to completely "flush" the tray even using "vacuuming" techniques.

SUMMARY OF THE INVENTION

As a consequence of the foregoing, it is an object of the present invention to provide a simple, high speed apparatus for modifying the atmosphere in individual trays and sealing the trays with film.

It is a further object of the present invention to provide an apparatus which can achieve the atmosphere modification and sealing on a continuous basis, such that multiple trays can be processed continuously, rather than by intermittent, "batch" processing.

In accordance with the present invention, as embodied and broadly described herein, the apparatus for atmosphere-modifying and sealing trays of the type having continuous peripheral edges comprises, a sealing station; means for advancing the trays past the sealing station; film supply means; and roller means positioned at the sealing station for receiving film from the film supply means and for disposing film to cover the trays including the edges. The roller means and a respective tray define a nip region through which the film passes to cover the tray, and gas flushing means is provided including means for injecting a preselected gas into the trays through the nip region and between the film and the trays. Means are further provided for sealing the disposed film to the edges of the gas flushed trays, and the sealing means are positioned proximate and downstream of the roller means relative to the advancing direction.

Preferably, the gas flushing means includes a preselected gas source and a first gas injection nozzle operatively connected therewith. The first gas injection nozzle is positioned upstream of the roller means relative to the advancing direction and has holes in its bottom or lower side for directing gas into the tray. The nozzle is proximate the roller means and commensurate with the transverse extent of the nip region.

The gas flushing means can optionally include a second gas injection nozzle operatively connected to the preselected gas source and oriented to flow gas across the leading portion of the edges of the advancing trays. The second gas injection nozzle has a nozzle opening positioned proximate and downstream of the roller means relative to the advancing direction.

In another aspect the present invention is a process comprising a) moving a tray and a sheet of film relative to each other so that the leading edge of the tray contacts the sheet of film; b) sealing the film to the tray's leading edge; c) injecting a gas into the tray beneath the film proximate the sealed leading edge while d) sealing the film to the side edges of the tray while continuing to inject gas into the tray; and, e) discontinuing the gas injection and sealing the trailing edge of the tray to the film.

The accompanying drawings, which are incorporated in the constituted part of this specification, illustrate a preferred embodiment of the invention and, together with the description, serve to explain the principles of the invention.

DESCRIPTION OF THE PREFERRED EMBODIMENT

Reference will now be made to the present preferred embodiment to the invention which is illustrated in the above-described drawings.

Figure 3:
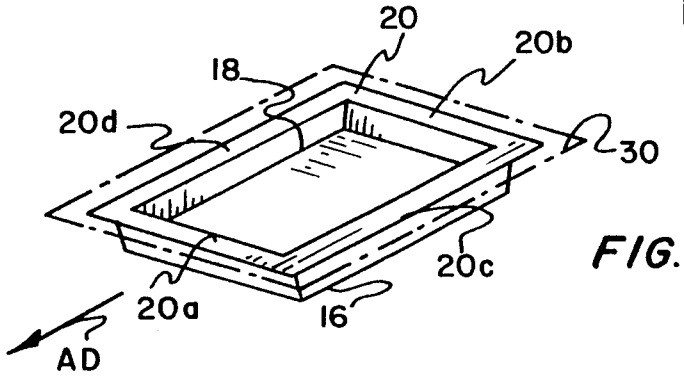
FIG. 3 is a schematic perspective view of a tray suitable for gas flushing and sealing by the apparatus depicted in FIG. 1.

In accordance with the present invention, apparatus for atmosphere-modifying and sealing trays of the type having continuous peripheral edges includes a sealing station and means for advancing the trays past the sealing station. As embodied herein and with initial reference to FIG. 1, the atmosphere-modifying and sealing apparatus designated generally by the numeral 10 includes sealing station 12 and conveyor 14 for advancing trays 16 past sealing station 12 in the direction denoted "AD" in the figures. Tray 16, the details of which do not form part of the present invention, is depicted in FIG. 3 as having a recessed part 18 and an upper continuous flanged edge part 20, including leading edge portion 20*a*, trailing edge portion 20*b*, and longitudinal side edges 20*c*, 20*d*, relative to the advancing direction. Tray 16 can be made of polystyrene or other suitable packaging materials known to those skilled in the art.

Figure 1:
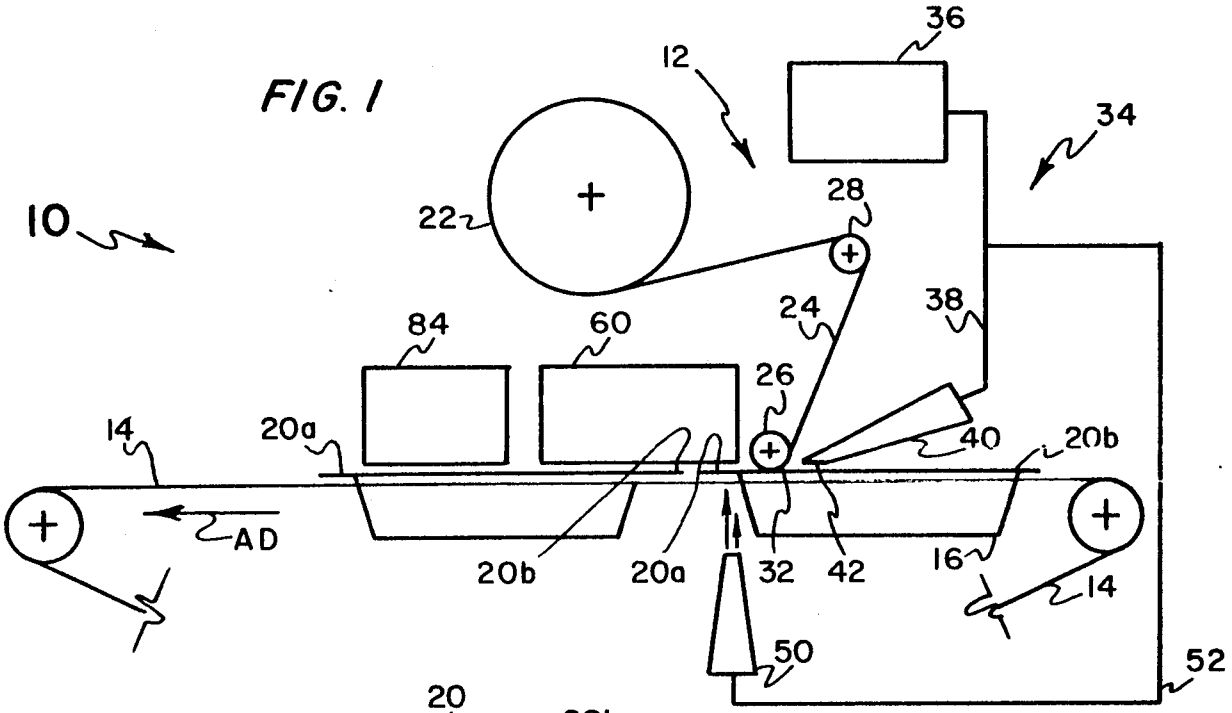
FIG. 1 is a schematic side view representation of apparatus for atmosphere-modifying and sealing trays made in accordance with the present invention.

Conveyor 14 depicted in FIG. 1 is a split-belt type conveyor operating at essentially constant speed. The individual trays 16 are suspended on the split belts by the respective longitudinal edges 20*c*, 20*d* and are carried past sealing station 12 in end-to-end relationship. Although only two trays are shown in the FIG. 1 depiction, it is to be understood that apparatus 10 as depicted and otherwise disclosed herein is capable of continuous operation. Also, the present invention is not intended to be limited to split-belt conveyors, and other advancing means can be utilized.

In accordance with the present invention, the apparatus further includes a film supply means and film disposing means positioned at the sealing station for receiving the film from the film supply means and for disposing the film to cover the tops of the advancing trays including the edges of the trays. The film disposing means together with the tray top including the edges define a nip region through which the film from the film supply means passes to cover the tray. As embodied herein and with continued reference to FIG. 1, supply roll 22 is positioned to feed film 24 to disposing roller 26 which is located near sealing station 12. A fixed bar (not shown) or other type of film disposing element could be used in place of roller 26 but the roller is presently preferred. One or more tensioning rollers, such as roller 28 can be employed to provide smooth transport of film 24 between supply roll 22 and disposing roller 26, as one skilled in the art would appreciate. Film suitable for use in the disclosed apparatus can be any of a number of single and multilayer films compatible with the modified gas atmosphere and contents of the tray. For example, for processing foodstuffs where transparency, heat sealability and low oxygen permeability are wanted, various materials manufactured and sold by the Cryovac division of W.R. Grace & Co., can be used. A Cryovac film material sold under the designation R669B was found to perform well when used in conjunction with a polystyrene tray in the present invention.

Film disposing roller 26 is positioned substantially transverse to the advancing direction and in close proximity to plane 30 defined the tray top including tray edges 20. See FIG. 3 showing a dotted line representation of the plane 30. Positioning disposing roller 26 no more than three-four film thicknesses from plane 30 enables continued contact to be more easily and stably maintained between edges 20 and film 24 after it has passed through nip region 32. This both improves the quality of the seal and also the retention of the modified gas atmosphere in tray 16 following the sealing operation to be discussed hereinafter.

Further in accordance with the present invention, the apparatus includes gas flushing means including means for injection a preselected gas into the trays through the nip region and between the film and the trays. As embodied herein, gas flushing means designated generally 34 includes a gas source 36 connected via conduit system 38 to gas injection nozzle 40. The particular type of gas will depend upon the particular application, such as the use of nitrogen gas to purge trays containing perishable foodstuffs in order to eliminate as much oxygen as possible or oxygen to enrich the oxygen content, depending on the particular application. However, the present invention is not limited to the particular gas or to applications involving packaging foodstuffs.

Nozzle 40 which comprises the gas injection means is positioned adjacent the nip region 32 and upstream of disposing roller 26 and has a transverse width 42. Nozzle 40 is positioned and oriented such that at least a portion of the gas flowing through the nozzle is directed substantially through nip region 32 below film 24 and into tray 16. Nozzle 40 can be fabricated from spaced apart plates such as plates 44, 46 (see FIG. 2A), and transverse width 42 should substantially span nip region 32.

Figure 2A:
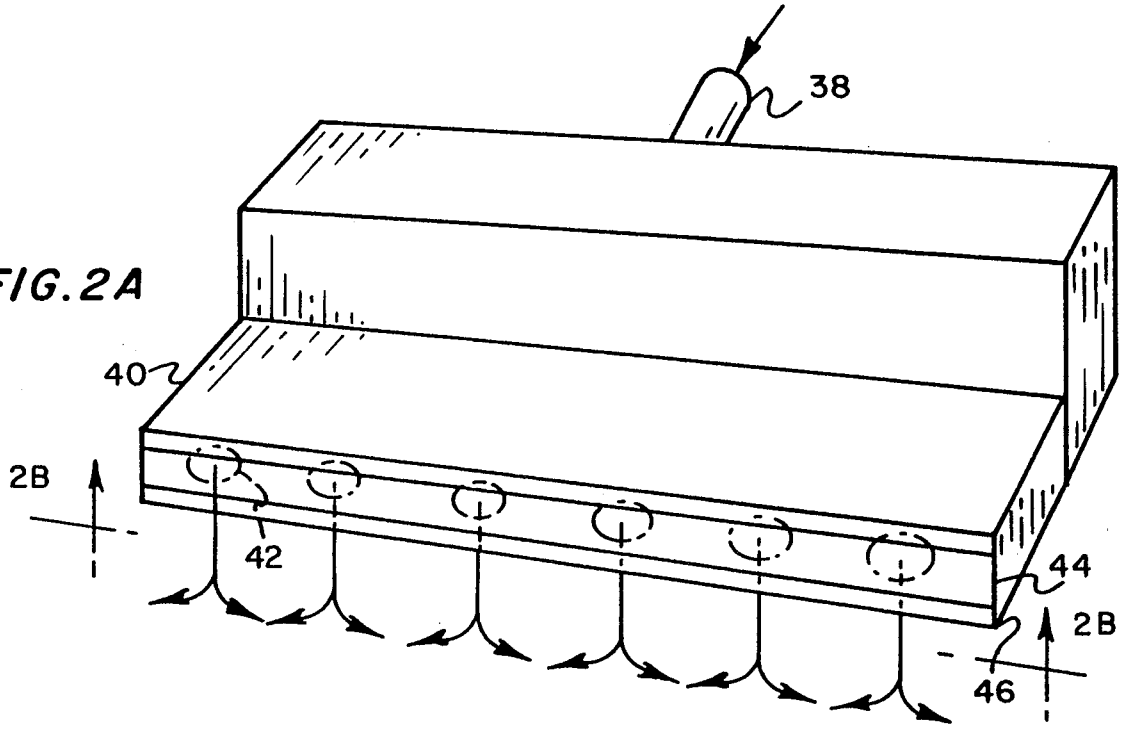
FIGS. 2(A) and 2(B) are, respectively, schematic plan view and partial bottom view depictions of the gas injection nozzle component of the apparatus depicted in FIG. 1.
Figure 2B:
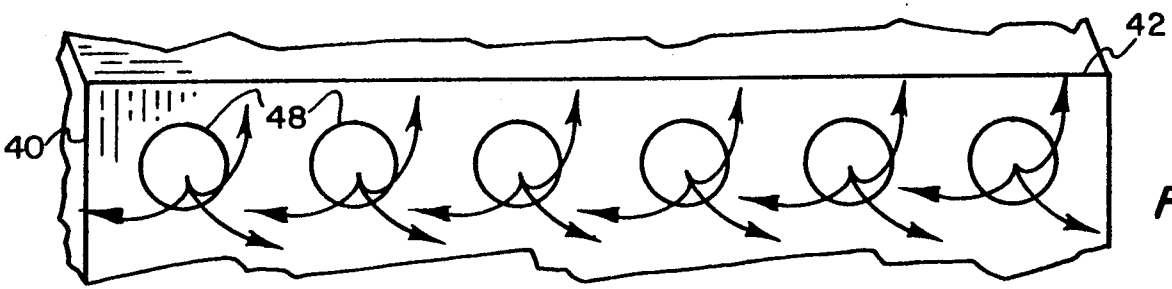

As embodied herein, and as best seen in FIGS. 2A and 2B, nozzle 40 includes a series of holes 48 (five being shown in FIG. 1) for delivering the gas flow through nip region 32 in a direction substantially perpendicular to the advancing direction and directly down into tray 16. It has been found that a significant increase in the efficiency of the flushing operation in terms of modifying the atmosphere of the trays can be achieved utilizing a nozzle constructed as shown in FIGS. 2A and 2B, which provides a flushing gas flow downward, perpendicular to the advancing direction, into tray 16. However, the present invention is not to be limited to this particular construction or orientation of the passages through which the modifying gas flows into the trays.

As embodied herein, gas flow means 34 optionally can include gas injection nozzle 50 positioned slightly downstream of the disposing roller 26, below conveyor 14, and oriented to flow gas upward across leading edge 20*a* each tray 16 as it passes nip region 32. Nozzle 50 can be supplied from the same gas supply source 36 through conduit 52, as shown in FIG. 1, or from a separate gas source. While nozzle 50 is not critical to the operation of the disclosed apparatus, more complete flushing occurs. It is believed that nozzle 50 acts to provide a gas curtain to prevent return flow of air into the flushed tray across the leading edge after it passes through nip region 32 and before it is permanently sealed by components to be discussed hereinafter. However, the theory of operation of nozzle 50 is not to be taken as a limitation on the invention defined by the appended claims.

The particular gas flow rate and pressures are a function of the tray size, conveyor speed, etc. For example, $N_2$ purging tests run with Formpac BT 972 trays having dimensions of 9"(l), 7"(w), and 2"(d), a film 7¼ inches wide, allowed 60 trays per minute to be processed using a $N_2$ flow rate of about 220 CFH. The nozzle 40 was configured with a transverse width 42 of about 7 inches and had a total of 104 holes 48 each 0.12" I.D. Nozzle 50 had a single opening of ⅜" dia. The residual $O_2$ content in the sealed trays was determined to be less than about 0.50%. One skilled in the art would be able to select suitable parameters for a particular application with a minimum of experimentation, given the present disclosure.

In accordance with the present invention, the apparatus further includes means for sealing the disposed film to the edges of the gas flushed trays. The sealing means are positioned proximate and downstream of the roller means relative to the advancing direction. As embodied herein, and as depicted schematically in FIG. 1, apparatus 10 includes sealing unit 60 positioned closely proximate and downstream of disposing roller 26. It is important to have the sealing unit 60 positioned as close as practicable to disposing roller 26, to achieve the best results in terms of maintaining the modified atmosphere and providing a good seal. Sealing unit 60 utilizes a pair of conventional band sealers (not shown) to continuously seal film 24 to longitudinal edges 20*c*, 20*d*. Sealing unit 60 also includes an intermittent, vertically and horizontally reciprocal "hot bar" sealer apparatus 62 to seal leading and trailing edges 20*a*, 20*b*. In the preferred embodiment of sealing unit 60, the conventional band sealers are positioned to act on the film covered tray before the leading and trailing edge sealer 62.

Figure 4:
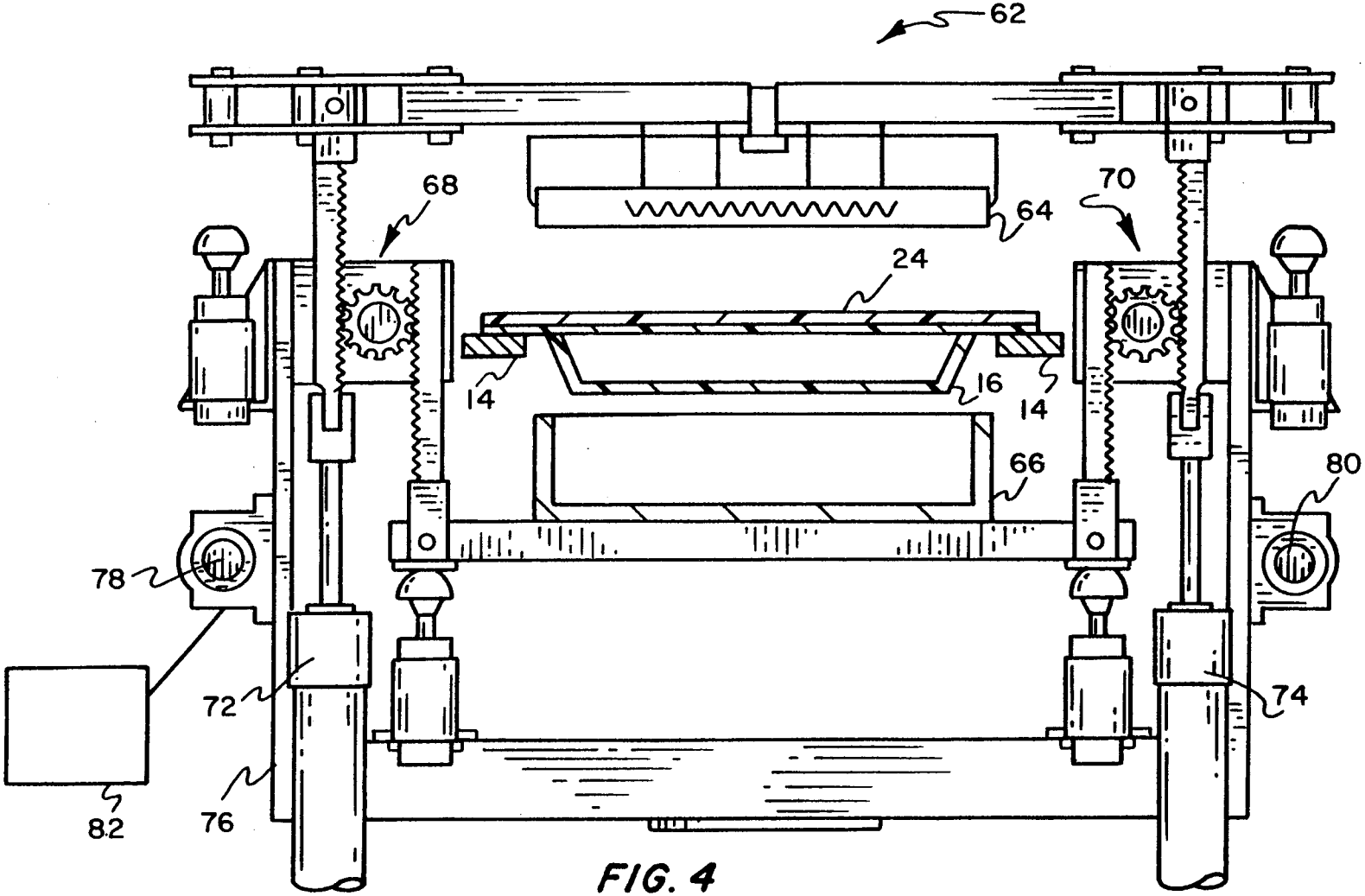
FIG. 4 is a schematic cross-section of the vertically and horizontally reciprocal leading and trailing edge sealer component of the apparatus depicted in FIG. 1.

As embodied herein, and with reference to FIG. 4, leading and trailing edge sealer 62 includes a heated top die 64 and a complementary opposing bottom die 66 configured to engage a film-covered leading or trailing edge 20*a*, 20*b* (not shown in FIG. 4) positioned therebetween. In the FIG. 4 embodiment, dies 64 and 66 are constrained for vertically reciprocal motion in opposite directions by a pair of rack and pinion assemblies 68, 70 disposed transversely to conveyor 14. Assemblies 68, 70 are driven by double-acting pneumatic units 72, 74 relative to frame 76 which is constrained to move horizontally along a pair of parallel slide rails 78, 80 in the longitudinal direction relative to conveyor 14. Horizontal reciprocal movement of frame 76 on slide rails 78, 80 is provided by drive unit 82 (shown schematically).

In operation, drive unit 82 moves frame 76 upstream relative to the conveying direction of conveyor 14 to a point closely adjacent the downstream end of the conventional band sealers, whereupon cylinders 77, 74 are activated to capture a film-covered edge 20*a* or 20*b* between vertically travelling opposing dies 64, 66. Drive unit 82 then moves frame 76 downstream at the same rate as conveyor 14 with the film-covered edge of tray 16 remaining captured until sealing has been accomplished. Cylinders 72, 74 are then activated in the reverse direction causing dies 64, 66 to release the film-covered edge and clear the tray, and drive unit 82 returns frame 76 upstream and the cycle is repeated for the next film-covered trailing or leading edge to be sealed. For a close tray-tray spacing, it has been found advantageous to simultaneously seal the trailing edge of one tray and the leading edge of the adjacent tray. One skilled in the art given the present disclosure, would readily be able to construct a suitable sealing unit and coordinate its operation with the balance of apparatus 10.

As further embodied herein, apparatus 10 includes trimming unit 84 disposed downstream of sealing unit 60 to conform the disposed film to the outer shape of tray edges 20 and to sever the film linking adjacent sealed trays. Although shown separately in the FIG. 1 depiction for clarity, the operation of trimming unit 84 could be combined with that of the sealing unit 60. Such a combination is particularly advantageous where minimum trimming occurs, such as where the transverse extent of the film coincides with the width of the trays and wherein the tray corners are reasonably square. In such a case, the remaining function of the trimming unit, namely severing of the film between adjacent trays, can be accomplished by incorporating a knife blade trimmer with the "hot bar" sealer 62 to sever the film linking the adjacent trays either during or immediately after the leading and trailing edges are sealed.

It will be apparent to those skilled in the art that various modifications and variations can be made in the above-described embodiment of the present invention without departing from the scope or spirit of the invention. Thus, it is intended that the present invention covers such modifications and variations provided they come within the scope of the appended claims and their equivalents.

What is claimed is:

1. A process for making a sealed tray having a modified atmosphere comprising the steps of:

a) continuously moving a tray and a sheet of film relative to each other so that the leading edge of the tray contacts the sheet of film and b) injecting a gas into the tray beneath the film proximate the first line of film-tray contact while c) sealing the film to the side edges of the tray, without the use of a vacuum/gas chamber, while continuing to inject gas into the tray; and d) sealing the film to the tray's leading edge;

e) continuing the gas injection and sealing the trailing edge of the tray to the film.

2. Apparatus for atmosphere modifying and sealing trays of the type having continuous peripheral edges, the apparatus comprising:

means for continuously advancing the trays past said sealing station;

film supply means;

means positioned at said sealing station for receiving film from said film supply means and for disposing said received film to cover the trays including the edges, said film receiving and disposing means with the respective tray defining a nip region through which said film passes to cover the tray;

gas flushing means including means for injecting a preselected gas into the trays through said nip region and between said film and the trays, said gas flushing means not including a vacuum/gas chamber; and means for sealing said disposed film to the edges of the gas flushed trays, said sealing means being positioned proximate and downstream of said film receiving and disposing means relative to the advancing direction.

3. The apparatus as in claim 2, wherein said receiving and disposing means is a roller.

4. The apparatus as in claim 2, wherein said gas flushing means includes a preselected gas source, said gas injection means being operatively connected therewith, said gas injection means being positioned upstream of said receiving and disposing means relative to the advancing direction and having at least one gas injection opening proximate said receiving and disposing means.

5. The apparatus as in claim 4, wherein said at least one gas injection opening is oriented to inject gas substantially perpendicular to the advancing direction.

6. The apparatus as in claim 2, wherein said gas injection means includes an injection nozzle having a width commensurate with the transverse extent of said nip region to inject the gas substantially perpendicular to the advancing direction and down into the filled trays.

7. The apparatus as in claim 2, wherein said film receiving and disposing means defines said nip region to be substantially transverse to the advancing direction.

8. The apparatus as in claim 2, wherein the tray advancing means is a substantially constant speed conveyor and wherein the trays are arranged in end-to-end relationship, and wherein said film receiving and disposing means, said gas flushing means, and said sealing means operate to dispose said film, flush the trays with said selected gas, and seal said flushed trays in a continuous manner.

9. The apparatus as in claim 2, further including means positioned downstream of said sealing station for trimming said sealed trays.

10. Apparatus for atmosphere modifying and sealing trays of the type having continuous peripheral edges, the apparatus comprising:

a sealing station;

means for advancing the trays past said sealing station;

film supply means;

means positioned at said sealing station for receiving film from said film supply means and for disposing said received film to cover the trays including the edges, said film receiving and disposing means with the respective tray defining a nip region through which said film passes to cover the tray;

gas flushing means including a first gas injection means for injecting a preselected gas into the trays through said nip region and between said film and the trays, and a second gas injection means for flowing across the leading portion of the edges of the advancing trays, said second gas injection means having a gas injection opening positioned proximate and downstream of said film receiving and disposing means relative to the advancing direction; and means for sealing said disposed film to the edges of the gas flushed trays, said sealing means being positioned proximate and downstream of said film receiving and disposing means relative to the advancing direction.

* * * * *